US009149401B2

(12) United States Patent
Davenport et al.

(10) Patent No.: US 9,149,401 B2
(45) Date of Patent: Oct. 6, 2015

(54) SUPPORT APPARATUS FOR PREVENTING AND/OR INHIBITING DECUBITUS ULCERS

(76) Inventors: Thomas Davenport, Manhasset, NY (US); Steven Stavrides, Wantagh, NY (US)

( * ) Notice: Subject to any disclaimer, the term of this patent is extended or adjusted under 35 U.S.C. 154(b) by 645 days.

(21) Appl. No.: 13/336,808

(22) Filed: Dec. 23, 2011

(65) Prior Publication Data

US 2013/0160208 A1 Jun. 27, 2013

(51) Int. Cl.

| | |
|---|---|
| ***A61G 7/057*** | (2006.01) |
| ***A61G 7/008*** | (2006.01) |
| ***A61G 7/018*** | (2006.01) |
| *A61G 7/10* | (2006.01) |
| *A61G 7/05* | (2006.01) |

(52) U.S. Cl.

CPC ..... *A61G 7/057* (2013.01); *A61G 7/008* (2013.01); *A61G 7/018* (2013.01); *A61G 7/1019* (2013.01); *A61G 7/1032* (2013.01); *A61G 7/1057* (2013.01); *A61G 2007/0509* (2013.01); *A61G 2007/0513* (2013.01)

(58) Field of Classification Search

CPC ..... A61G 7/018; A61G 7/008; A61G 7/057; A61G 7/0509–7/0513; A61G 7/1019; A61G 7/1057; A61G 7/1032

USPC ..... 5/609, 607, 608, 612, 120, 81.1 R, 5/81.1 HS, 81.1 C; 198/321; 193/35 R

See application file for complete search history.

(56) References Cited

U.S. PATENT DOCUMENTS

| | | | | |
|---|---|---|---|---|
| 3,302,219 | A * | 2/1967 | Harris | 5/85.1 |
| 3,875,598 | A * | 4/1975 | Foster et al. | 5/607 |
| 3,924,281 | A * | 12/1975 | Gibbs | 5/88.1 |
| 4,222,133 | A * | 9/1980 | Csatary | 5/604 |
| 4,270,234 | A * | 6/1981 | James | 5/88.1 |
| 4,357,722 | A * | 11/1982 | Thompson | 5/606 |
| 4,797,960 | A * | 1/1989 | Vaiana et al. | 5/81.1 C |
| 4,843,665 | A * | 7/1989 | Cockel et al. | 5/88.1 |
| 4,941,220 | A * | 7/1990 | DiMatteo et al. | 5/81.1 C |
| 4,945,585 | A * | 8/1990 | Stewart | 5/122 |
| 5,018,225 | A * | 5/1991 | Fergni et al. | 5/607 |
| 5,054,140 | A | 10/1991 | Bingham et al. | |
| 5,138,646 | A * | 8/1992 | Hubert et al. | 378/177 |
| 5,469,588 | A * | 11/1995 | DiMatteo et al. | 5/81.1 C |
| 5,640,729 | A | 6/1997 | Marino | |
| 5,659,905 | A | 8/1997 | Palmer, Jr. et al. | |
| 6,363,555 | B1 * | 4/2002 | LaRose | 5/600 |
| 6,499,156 | B1 * | 12/2002 | Dirst | 5/600 |
| 6,651,281 | B1 * | 11/2003 | Figiel | 5/612 |
| 7,293,303 | B2 * | 11/2007 | Worrell | 5/81.1 R |
| 8,087,109 | B2 * | 1/2012 | Hillenbrand, II | 5/81.1 HS |
| 8,745,779 | B2 * | 6/2014 | Roberg | 5/81.1 C |
| 2003/0110559 | A1 * | 6/2003 | Weigand | 5/81.1 R |
| 2005/0055772 | A1 * | 3/2005 | Maschke | 5/601 |
| 2007/0151025 | A1 * | 7/2007 | Wei et al. | 5/81.1 R |
| 2008/0047067 | A1 * | 2/2008 | Hornbach | 5/607 |
| 2009/0013469 | A1 * | 1/2009 | Johnson | 5/612 |

* cited by examiner

*Primary Examiner* — Peter M Cuomo
*Assistant Examiner* — Brittany Wilson
(74) *Attorney, Agent, or Firm* — Hoffmann & Baron, LLP

(57) ABSTRACT

An apparatus and method for preventing decubitus ulcerations including a frame having a pair of frame supports spaced from each other. A mattress is supported on the frame between the frame supports. A pliable support material extends between the supports. The material is adapted to support an individual thereon in a generally recumbent position. A lift mechanism is disposed on the frame and operably connected to the support material. The lift mechanism adjusts the tension of the material so that the support has a first position resting on the mattress and a second position wherein the support is raised above the mattress.

21 Claims, 14 Drawing Sheets

SUPPORT APPARATUS FOR PREVENTING AND/OR INHIBITING DECUBITUS ULCERS

FIELD OF INVENTION

The present invention relates to an apparatus for supporting a patient and, more particularly, to an apparatus for selectively supporting a patient in order to relieve pressure exerted on the patient by a contact surface to prevent and/or inhibit decubitus ulcers.

BACKGROUND

Individuals who are bed bound or confined to a wheel chair for long periods of time are at risk for developing decubitus ulcers, commonly referred to as bed sores or pressure sores. The ulcers typically appear and develop at the location of a bony prominence on a patient's body and the immediate area of such bony prominence, especially at or around the buttocks, coccyx, spine, hips, elbows and heels. Such ulcers are caused by direct contact pressure by an object (such as furniture, e.g., a bed; wheel chair; etc.) with the bony prominence and its immediate area. The ulcers are areas of damaged skin and tissue that develop when sustained pressure cuts off circulation to these vulnerable parts of the body. Without adequate blood flow, the affected tissue dies.

Decubitus ulcers can range from a very mild pink coloration of the skin, which disappears in a few hours after pressure is relieved on the area, to a very deep wound extending to and sometimes through a bone into internal organs. These ulcers are classified in stages according to severity.

The ulcers can develop quickly and progress rapidly. For example, in unconscious patients or those who have had injury to the spinal cord, a large pressure sore can develop as soon as twelve hours after onset of a disability or the injury. The ulcers are often difficult to heal. Once developed, they can lead to infection and seriously impact the health of the patient.

The sacral area of the back is most prone to such ulcers due to the proximity of the bones to the skin's surface and the amount of weight bearing on this area. An ulcer on the sacral area may even develop from a patient's position on the operating table during an extended operation. Manually shifting the position of the patient during surgery can be disruptive to the ongoing procedure.

Since the ulcers are difficult to treat, it is important that attention is given to prevent them from forming. The classic procedure for prevention is for a caregiver to rotate a patient every two hours so that pressure can be relieved and no single area of the body is under prolonged periods of pressure. While effective, this procedure requires a significant amount of staffing and strict adherence to schedules for the procedure to be effective.

Various systems exist, such as elaborate hospital beds, for alleviating areas of pressure exerted on a bed bound individual. However, such beds are expensive and impractical for large institutions treating many such individuals.

Accordingly it would be desirable to provide an economical device for changing the position of an individual to alleviate areas of localized pressure.

SUMMARY OF THE INVENTION

The present invention provides an apparatus for preventing and/or inhibiting decubitus ulcers. The apparatus includes a frame having a pair of frame supports spaced from each other. A contact surface (e.g., a mattress) is supported on the frame between the frame supports. A pliable support material extends between the frame supports. The material is adapted to support an individual thereon in a generally recumbent position. A lift mechanism is disposed on the frame and operably connected to the support material. The lift mechanism adjusts the tension of the support material so that the support material has a first position resting on the contact surface and a second position wherein the support material is raised above the contact surface.

The present invention also provides an apparatus for supporting a patient including a bed having a frame having first and second end supports spaced from each other. A contact surface (e.g., a mattress) is supported on the frame between the first and second frame end supports. A patient support extends between the first and second frame end supports and includes a web of material disposed over the contact surface adapted to support the patient. A lift mechanism is disposed on the frame and is operably connected to the web of material. The lift mechanism moves the web of material between a first position wherein the patient support rests on the contact surface and a second position wherein the patient support is raised above the contact surface.

The present invention still further provides an apparatus for preventing and/or inhibiting decubitus ulcers including a frame including a pair of frame supports spaced from each other. A contact surface is supported on the frame between the frame supports. A pliable support material extending between the frame supports, the material is adapted to support an individual thereon in a generally recumbent position. A positional shifting device is supported on the frame and is operably connected to the support material. A controller is operably connected to the positional shifting device. The controller emits signals to cause the shifting device to periodically adjust the position of the support material relative to the contact surface to adjust the position of the individual.

The present invention still further provides a method of preventing and/or inhibiting decubitus ulcers. The method comprises supporting an individual on a bed having a mattress disposed in a frame including a pair of frame supports spaced from each other, the bed including a pliable material extending between and operably connected to the frame supports, the material adapted to support an individual thereon in a generally recumbent position; moving the material disposed over the mattress relative to the mattress to redistribute the weight of the individual relative to the mattress for a predetermined period of time; and following the predetermined time moving the material disposed over the mattress to lower the individual onto the mattress, wherein the individual is substantially supported by the mattress.

DETAILED DESCRIPTION OF THE PREFERRED EMBODIMENT

The present invention provides an apparatus for supporting an individual (e.g., a patient) in a recumbent, or substantially recumbent, position in order to prevent and/or inhibit the formation of decubitus ulcers. A recumbent, or substantially recumbent, position is any position in which an individual is lying down, substantially lying down, or sitting down. The present invention also includes methods of preventing and/or inhibiting the formation of decubitus ulcers in individuals in a recumbent, or substantially recumbent, position by periodically redistributing the weight of the individual.

Decubitus ulcers are formed when pressure is exerted for a period of time on one portion of the body by a contact surface. Contact surfaces include any surface which exerts pressure on an individual's body. Examples of contact surfaces include a mattress, an operating table, and a box spring. Such pressure results in a reduction of blood flow leading to a breakdown in tissue thereby forming such ulcers.

The apparatus of the present invention periodically redistributes the weight of the individual by elevating an individual away from a contact surface in order to remove the pressure to any single region of the body and allow blood to freely circulate thereby keeping the tissue healthy.

Figure 1:
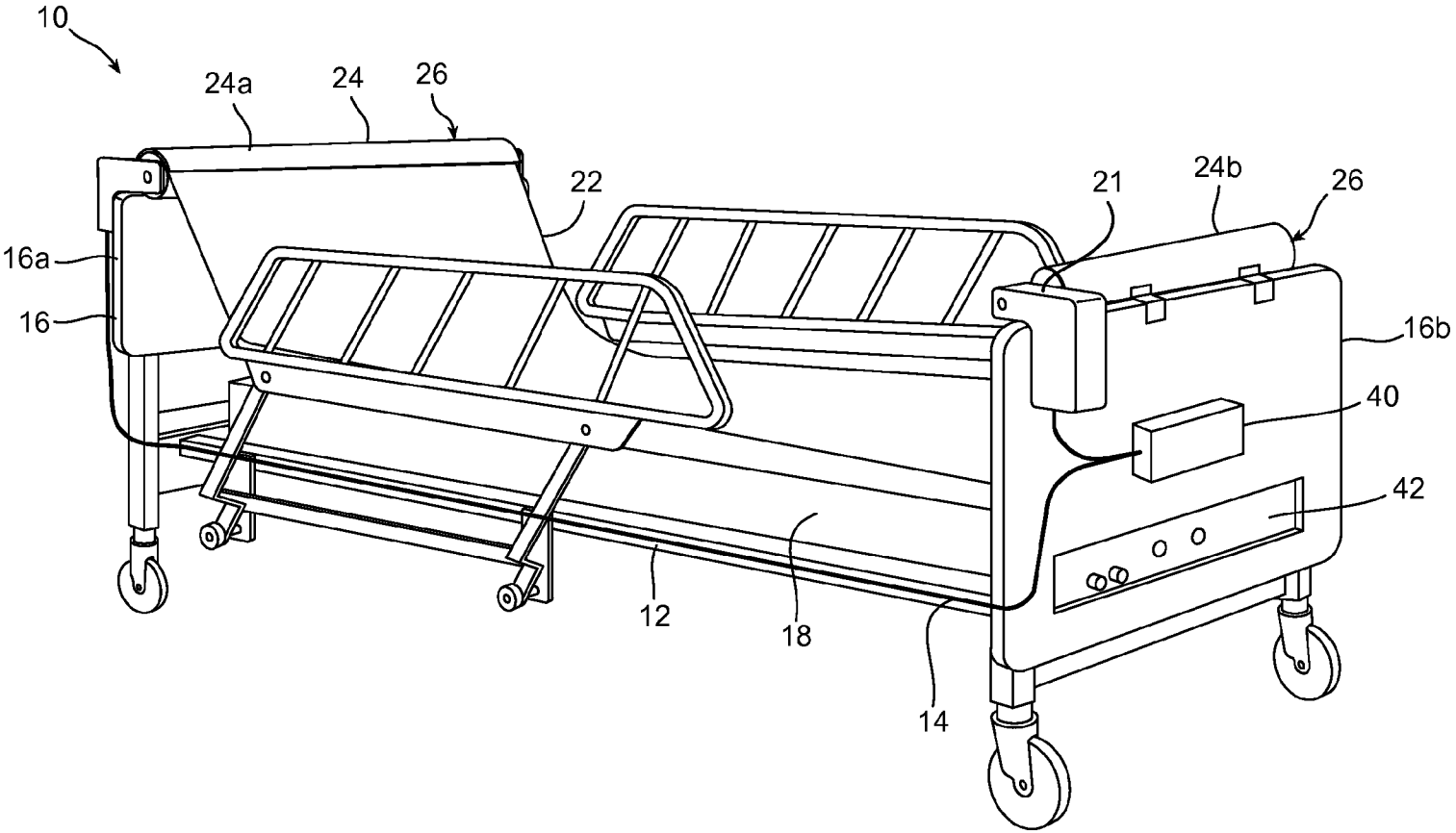
FIG. 1 is a perspective view of the patient support apparatus of the present invention.
Figure 2:
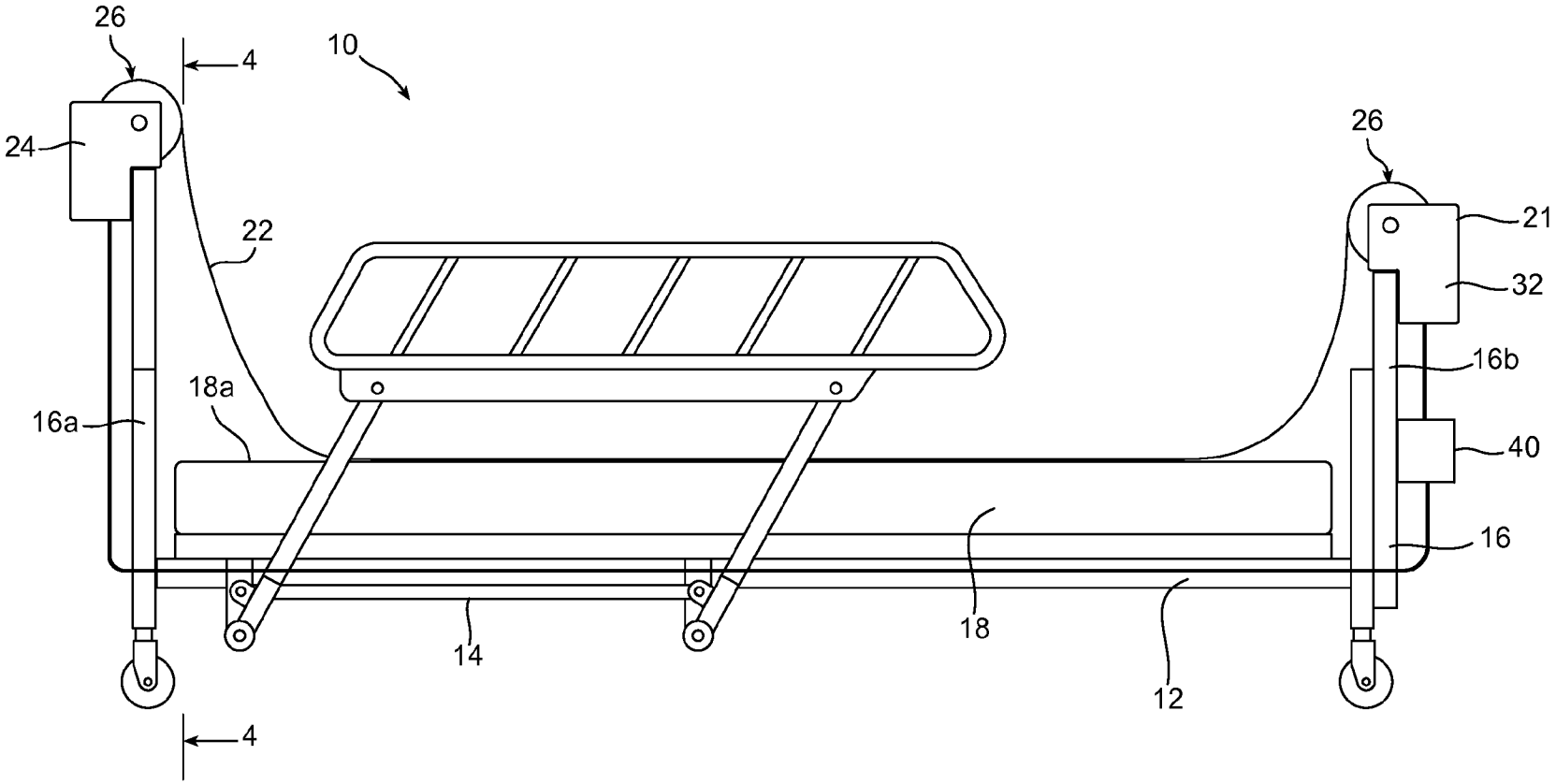
FIG. 2 is a side elevational view of the patient support apparatus showing a support in a first position.
Figure 3:
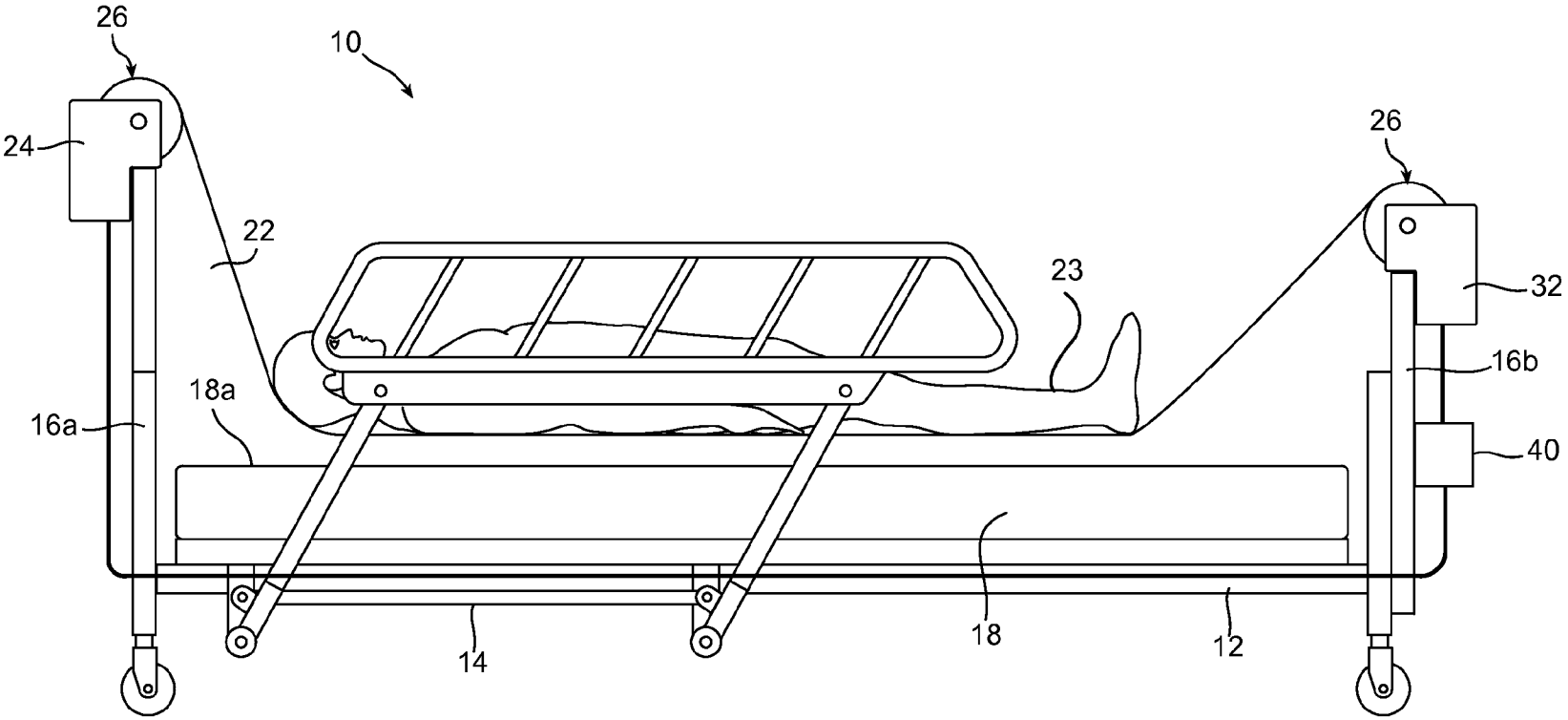
FIG. 3 is a side elevational view of the patient support apparatus showing a patient support apparatus in a second position.

With reference to FIGS. 1-3, the patient support apparatus 10 may be fitted to a bed 12 including a frame 14 having spaced end frame supports 16. The frame end supports may be in the form of a headboard 16*a* and footboard 16*b* of the bed. A contact surface 18 is disposed and supported between the two frame end supports 16. The contact surface may be of a type known in the art such as a mattress used for hospital beds and ICU beds. The patient support apparatus 10 may be secured to the frame 14 and extend over and above the contact surface 18.

The patient support apparatus 10 may include a support surface 22 including a web of pliable fabric material such as Lycra®, positioned above the contact surface 18. The support surface may support an individual 23 in a generally recumbent position. The individual is positioned on the bed such that the support surface 22 is disposed between the individual and the contact surface 18. The patient support apparatus 10 may further include a positional shifting device 21 for shifting the position of the support surface relative to the contact surface. The positional shifting device 21 may include a lift mechanism 24 secured to the end frame supports 16 at a position above the contact surface 18. The lift mechanism 24 may include a first lift device 24*a* secured to the headboard 16*a* and a second lift device 24*b* secured to the footboard 16*b*. The support surface 22 extends between the first and second lift devices 24*a*, 24*b*.

Figure 4A:
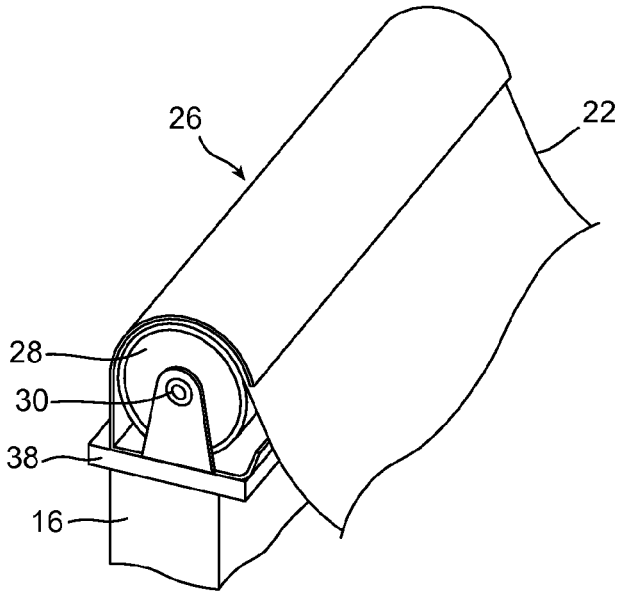
FIG. 4A is a perspective view of a roller assembly of the present invention.
Figure 4B:
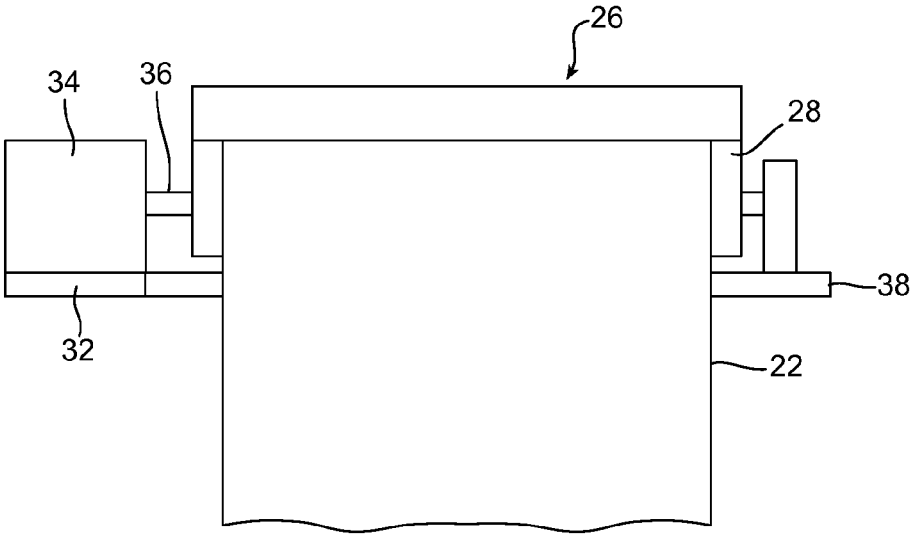
FIG. 4B is a front elevational view of a roller assembly of the present invention.

In this embodiment, the lift mechanism 24 may operate to adjust the length of the material of the support surface 22 extending between the frame end supports 16 so that the material 22 can be selectively raised and lowered with respect to the contact surface 18. The first and second lift devices 24*a*, 24*b* may each include a roller assembly 26 disposed on the top of each frame end support 16 and spaced a distance above the contact surface 18. With reference to FIGS. 4A and 4B, each roller assembly 26 may include an elongate tubular roller 28. An end of the material 22 is fixedly secured to the roller 28. The roller 28 may be supported at each end on bearings 30. One end of roller 28 may be operably coupled to a roller drive 32. Each roller drive 32 may include a motor 34 and shaft 36 which is operably coupled to the roller 28. Operation of the motor 34 causes the roller 28 to rotate thereby adjusting the length of the material. Alternatively, the roller drive may include a manually operated device, instead of a motor, such as a hand crank of a type known in the art.

It is within the contemplation of the present invention that the patient support apparatus 10 may be fitted to a standard hospital bed with only minor modifications to the bed. The roller assembly 26 may include a base 38 which is clamped or fastened to a top portion of the headboard 16*a* and footboard 16*b*. Alternatively, a specialized bed could be provided wherein the lifting mechanism 20 is integrally formed within the frame end supports.

Upon actuation of the motor 34, the roller 28 will rotate thereby taking up and shortening the material extending between the frame end supports 16. The direction of the roller drives 32 can be reversed in order to feed out material. Accordingly, upon operation of the lift mechanism 24, the length of the material 22 extending between the frame end supports 16 can be adjusted. As the roller assemblies 26 are activated such that the rollers 28 rotate to shorten the length of the material 22, the tension of the material is increased. As it is tensioned, the material tends to move upwardly and will be separated from the top of the contact surface, e.g., the mattress upper surface 18*a*, as shown in FIG. 3. The material 22 may be tensioned such that the material and patient lying thereon are raised just above the contact surface such that the contact surface 18 no longer exerts any force on the individual. The support material 22 is essentially suspended between two end points and tends to act as a hammock cradling the patient 23. The support material 22 may have a stretchable nature so that the weight of the individual is dispersed evenly across the surface of the individual and no pressure points are created. By relieving localized pressure points, the formation of decubitus ulcers can be prevented and/or inhibited.

After a predetermined time is expired, roller assemblies 26 are again activated wherein the rollers 28 rotate in an opposite direction in order to feed out support material and slacken the tension thereof, thereby allowing the individual 23 to be lowered back onto the contact surface 18.

Figure 5:
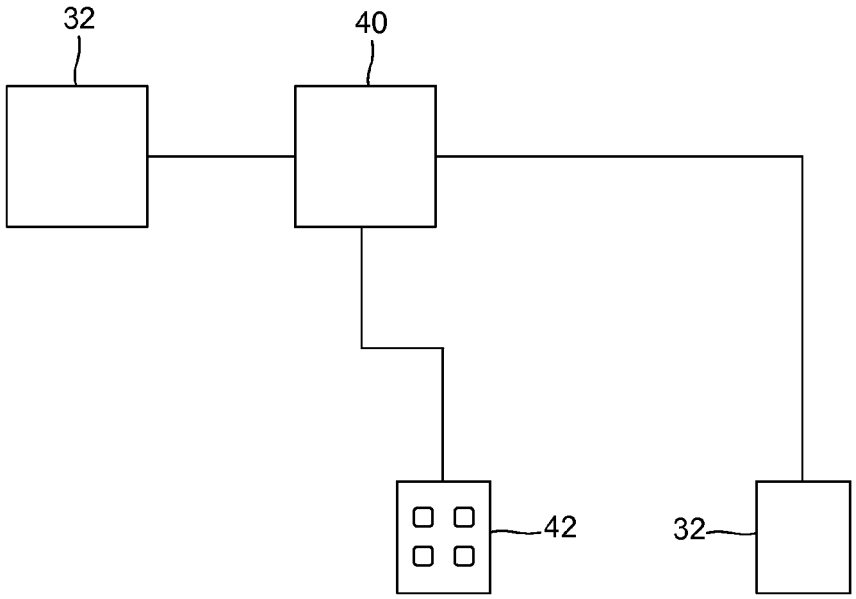
FIG. 5 is a schematic illustration of a controller of the present invention.

With further reference to FIG. 5, the roller drives 32, which cause the rotation of the rollers 28, may be attached to a controller 40. The controller 40 may include a processor and other related hardware and software to affect control over the roller drives 32. The controller 40 may be operably connected to an input device 42 which allows a patient or caregiver to input parameters for operating the roller drives. Such parameters may include the time period during which the individual is raised above the contact surface 18 and the time period in which the individual is supported by the contact surface. Accordingly, an operator could set the parameters, and the controller would automatically raise and lower the patient at desired intervals. Alternatively, an operator could manually raise and lower the patient when desired. The controller 40 emits signals to cause the roller drives to periodically adjust the position of the support material relative to the contact surface 18 to adjust the position of the patient 23. Selectively raising and lowering the support material 22 reduces pressure points so that localized pressure on the individual's skin does not develop for prolonged periods of time, thereby preventing ulcers. The input device 42 may be in the form of a numeric or alpha-numeric keypad or other input device as known in the art. Input device 42 may also include keys such as up and down arrows to allow an operator to raise or lower a patient when desired.

It is within the contemplation of the present invention that the lift mechanism 24 may include one roller assembly 26 located on one of the frame end supports 16. One end of the support material 22 may be secured to the one roller assembly 26. The other end of the support material 22 may be fixed to the other frame end support. Activating the roller of the roller assembly 26 will cause the length and tension in the support material 22 to be varied thereby raising and lowering the support material 22 and the patient thereon.

It is further within the contemplation of the present invention that the support surface material 22 may be acted on by the lift mechanism 24 such that in a first state, a patient remains in contact with the contact surface but that the weight of the patient is substantially borne by the support surface material 22. The support surface material 22 may then be moved to a second state so that the weight of the patient is substantially borne by the contact surface. For example, the roller assemblies 26 may be activated to adjust the tension of the support surface material 22 so that the weight of the patient is substantially borne by the support surface for a period of time. After this time expires, the roller assemblies may reduce the tension on the support material 22 such that a substantial portion of the patient's weight is borne by the contact surface.

In operation of the patient support apparatus 10, a user would input into the controller 40 an instruction which would cause the roller drives 32 to operate simultaneously to reduce the tension on the support material such that it lies directly on the top of the contact surface, e.g., mattress upper surface 18*a*. An individual may then be placed onto the support material and be supported by the contact surface. A user may also input into the controller 40 a particular time period for which the individual is to be supported by the contact surface and a time period that they are to be supported by the support material 22 above the contact surface 18. Once the parameters are entered, the controller 40 can execute the instructions. For a first predetermined time period, the individual will be supported by the contact surface 18. When this time period expires, the first and second lift assemblies will be activated thereby turning the rollers 28 simultaneously in a first direction. This results in the length of the support material 22 being shortened such that the tension on the support material is increased to the point where the individual is lifted and supported above the contact surface 18. The rollers 28 will then stop and maintain the tension on the support material, thereby keeping the individual supported above the contact surface for a second predetermined time period. After this second time period expires, the roller drives will reverse direction such that the support material 22 will be feed out thereby reducing the tension on the support material and lowering the individual until they are supported by the contact surface. The roller drives will then again stop. The process may then be repeated in a cyclic manner. This cyclic tensioning and slackening of the support material will continue such that individual is not subjected to localized pressure for an inordinate amount of time. Accordingly, the formation of decubitus ulcers is prevented and/or inhibited.

In alternative embodiment, the roller assemblies 26 may be independently operated so that one end of the support 22 may be raised or lowered independent of the other. For example, the roller assembly 26 on the head board 16*a* may be lifted to elevate a patient's head. Alternatively, the roller assembly 26 on the footboard 16*b* may be activated to elevate the feet of a patient.

Figure 6:
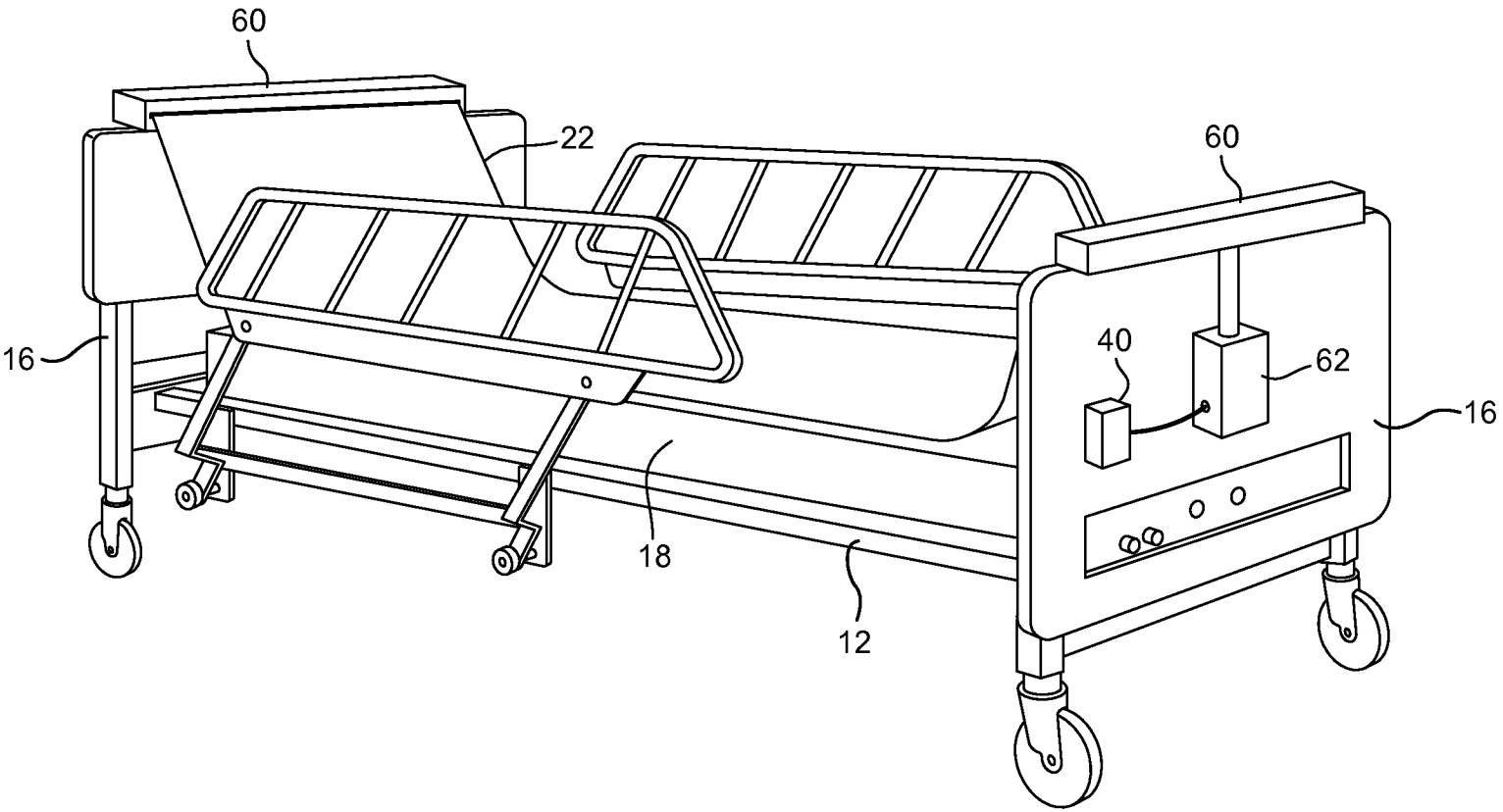
FIG. 6 is a perspective view of an alternative embodiment of the present invention.
Figure 7:
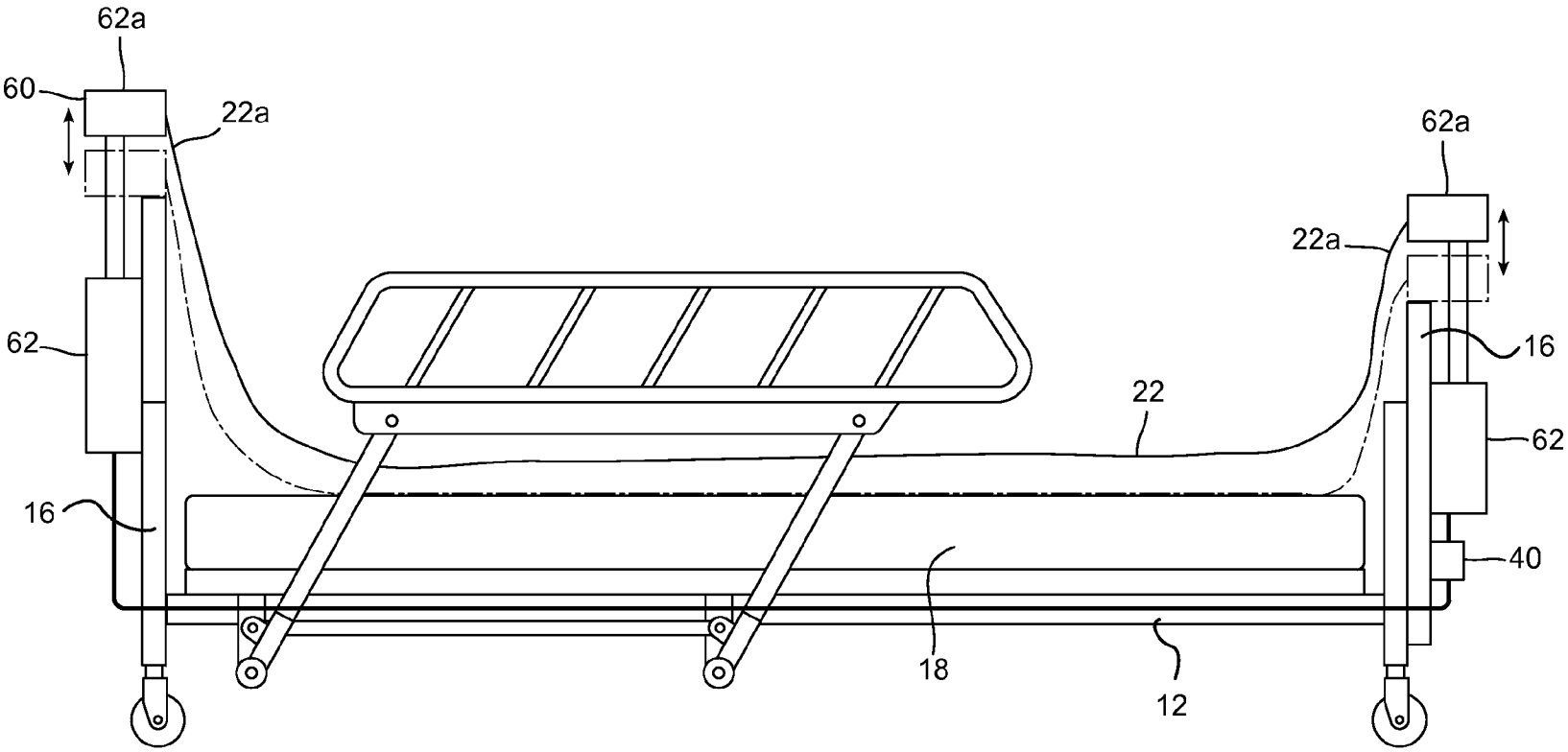
FIG. 7 is a side elevational view of the alternative embodiment of the present invention.

An alternative embodiment of the patient support apparatus 10 is shown in FIGS. 6 and 7. The apparatus is similar to that described above except for the lift mechanism. In this embodiment, the lift mechanism 60 may include a pair of lift devices in the form of linear actuators 62 disposed on the bed frame end supports 16. The linear actuators 62 may be in the form of a pneumatic or hydraulic cylinder, a linear electric motor, or other linear drive as known in the art. The actuators 62 may be generally vertically disposed on the frame end supports and able to move in a generally up and down direction. The actuator ends of the may include an elongate generally horizontal member 62*a* which extends along the width of the support surface 18. The support material 22*a* may be operably connected to the actuator ends 62*a* such that the ends of the support material may be raised and lowered. Accordingly, when an individual is to be supported by the contact surface 18, the actuators 62 may have a first lowered position as shown in FIG. 6 and in phantom in FIG. 7. When it is desired to support the individual above the contact surface 18, the ends of the actuators 62*a* may extend upwardly to a second position thereby lifting the ends of the support material. The support material 22 and the individual supported thereon are thereby raised above the contact surface as shown in FIG. 7. The actuators 62 may be operably connected to a controller 40 which would send signals to the linear drives such that the cyclic raising and lowering of the patient is achieved. As in the previously described embodiment, the controller may include an input to permit the time periods of supporting a patient on and above the contact surface may be entered.

In addition to, or as an alternative to, supporting the patient above the contact surface 18, it may also be beneficial to redistribute the weight of the patient 23 by shifting the patient from side to side to periodically alleviate pressure from parts of the body. In a further alternative embodiment shown in FIGS. 8-9, the patient support apparatus 10 may have a positional shifting device 21 including a pivot mechanism 70. The pivot mechanism 70 may pivot the support material about a longitudinal axis L-L running along the length of the support material to shift the weight of the patient. The pivot mechanism may be operably connected to a controller 78. The controller 78 may include hardware and/or software for generating signals for operation of the pivot mechanism. The controller 78 may operate the pivot mechanism such that the support material 22 is pivoted to one side for a predetermined amount of time and then pivoted toward the other side for a period of time. This periodic shifting of the patient's weight helps to alleviate pressure points and inhibit the formation of decubitus ulcers.

Figure 8:
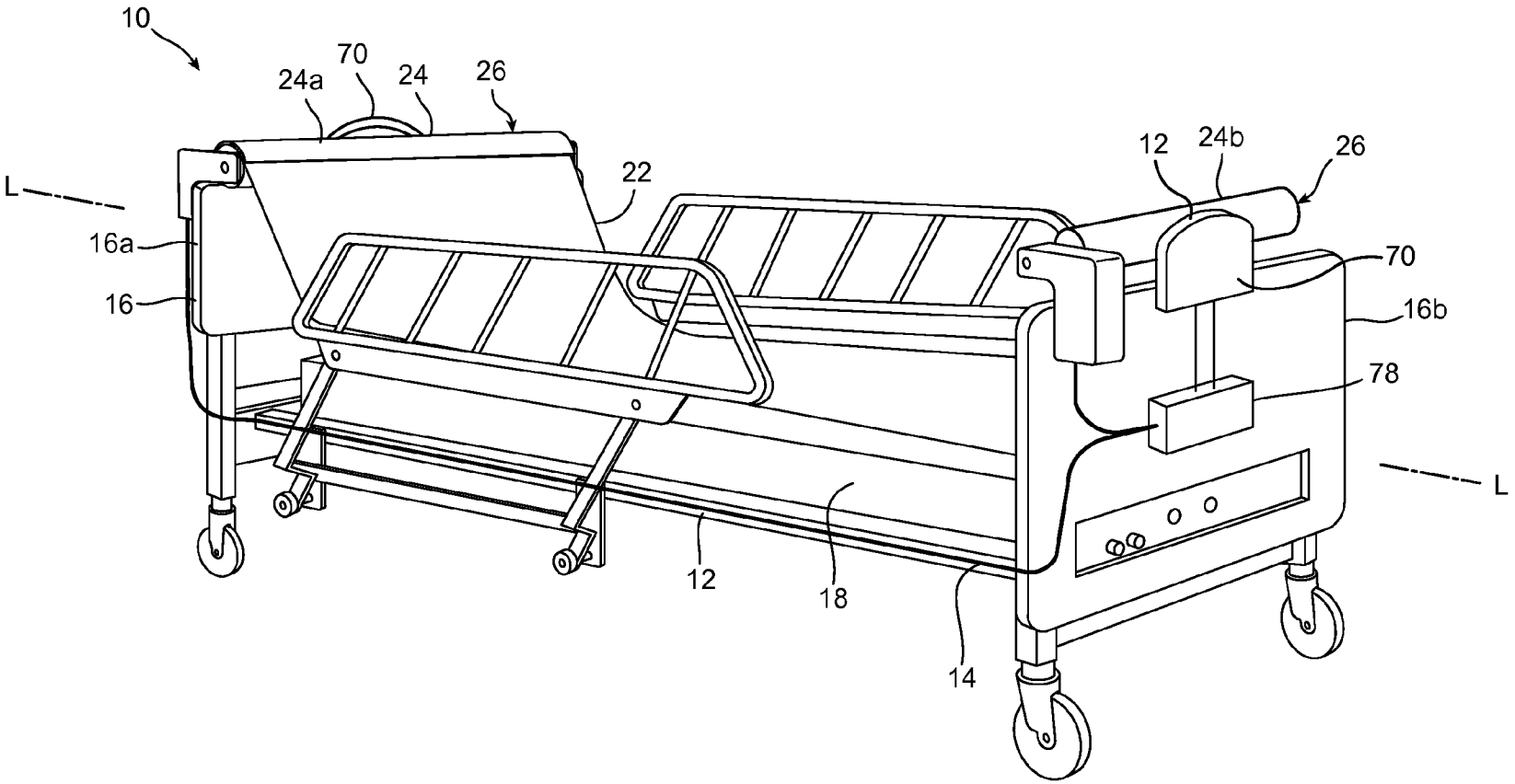
FIG. 8 is a perspective view of an alternative embodiment of a patient support apparatus of the present invention.
Figure 8A:
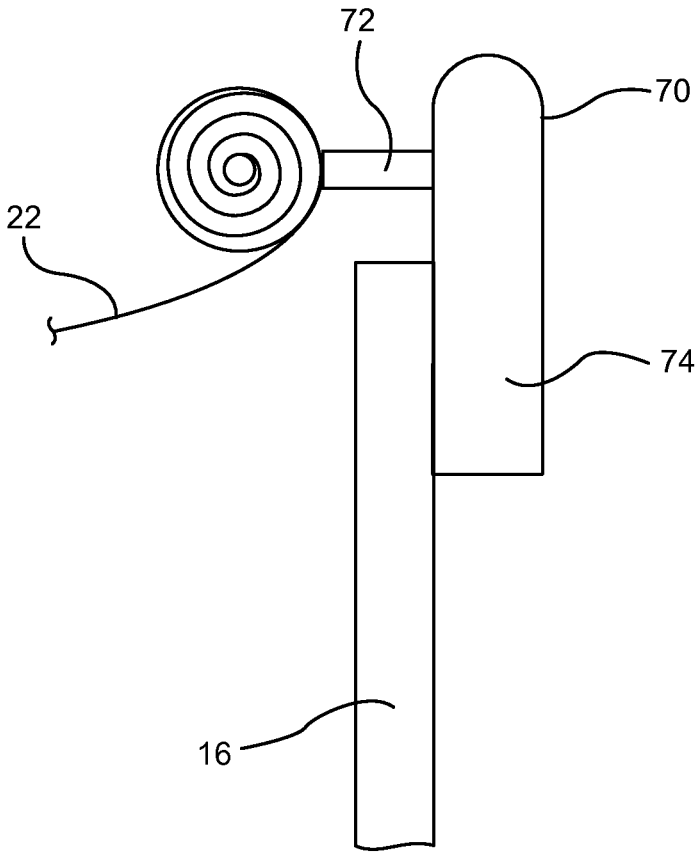
FIG. 8A is a partial side view of a pivot mechanism of FIG. 8.
Figure 9:
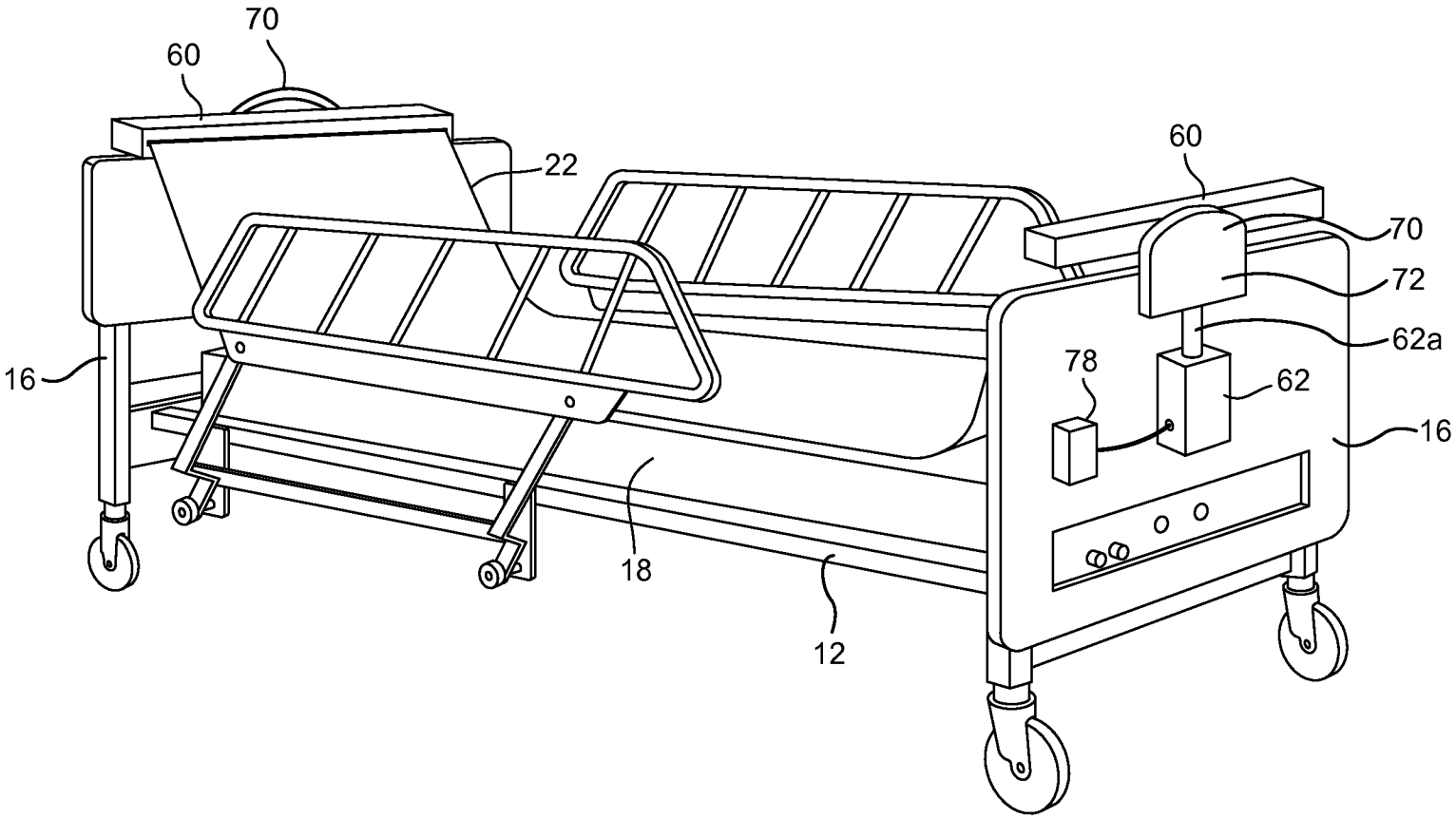
FIG. 9 is a perspective view of a further alternative embodiment of a patient support apparatus of the present invention.

In the embodiment shown in FIGS. 8, 8A, and 9, the pivot mechanism 70 may be in the form of a pair of rotary actuators 72 with one disposed between each of the end frame supports 16 and the lift mechanism 24. The rotary actuators 72 may each have a base 74 fixedly secured to one of the end frame supports 16. A shaft 76 may extend from the base 74 and be fixedly secured to the roller assembly 26 by way of a coupling (not shown). The rotary actuators 72 may be driven hydraulically, automatically, electrically, or in any other manner know in the art.

The pair of rotary actuators 72 may be operably connected to the controller 78. The controller 78 may be programmed to cause the rotary actuators 72 to rotate in unison so that the support material tilts to one direction or the other. The controller may be operably connected to an input device 80 which allows a user to control the cycle rate of tiling.

The pivot mechanism 70 may have three basic positions, a tilt left, level, and tilt right. By controlling the actuators 72 of the pivot mechanism, the weight of the patient can be gently shifted from side to side, thereby alleviating prolonged pressure on one area of the body.

In operation, the lift mechanism 24 may be controlled to lift the patient 23 just above the contact surface 18. From this lifted level position, the pivot mechanism 70 may then be operated to tilt the patient from side to side in a slow and controlled manner. Alternatively, the pivot mechanism 70 may be operated while the patient 23 is supported provably by the contact surface 18. In this case, the pivot action caused by the pivot mechanism 70 would cause the patient 23 to shift from side to side on the contact surface 18.

It is also within the contemplation of the present invention that the pivot mechanism may be used alone without the lift mechanism. The pivot mechanism 70 would be able to shift the weight of the patient from side to side while they are supported on the contact surface 18. In such an embodiment, a rotary actuator 72 may be secured to the frame supports and to the support material 22.

Figure 10:
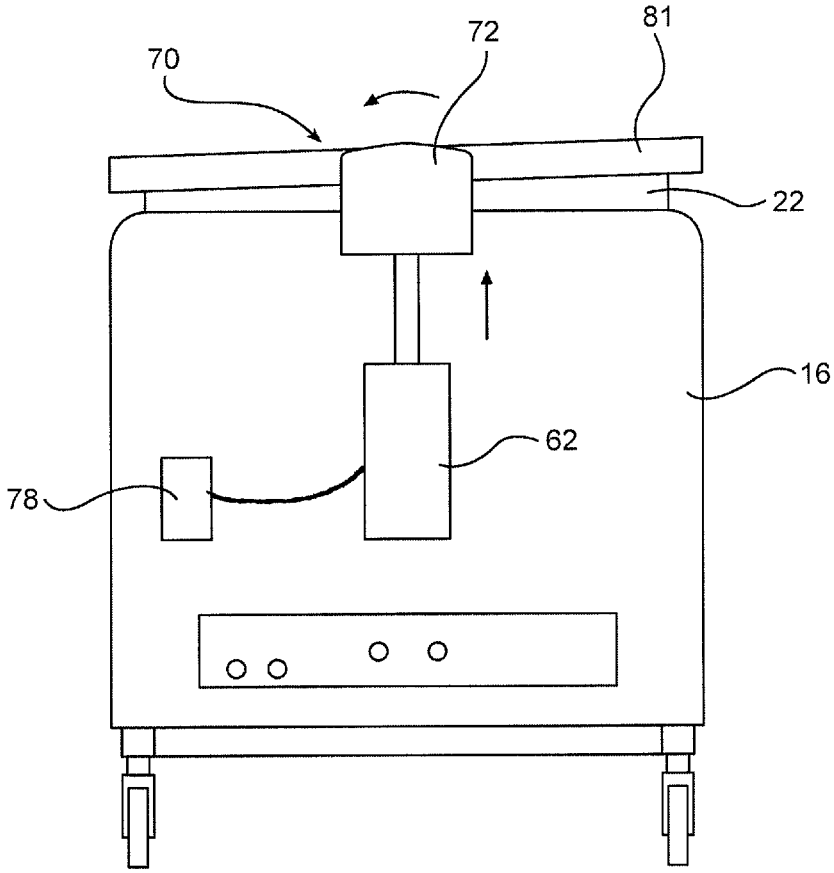
FIG. 10 is a schematic end view of the patient support apparatus of FIG. 9.

In the embodiment of the lift mechanism 60 shown in FIGS. 6 and 7 may be modified to include a pivot mechanism 70. With reference to FIGS. 9 and 10, the end of each of the actuators 62*a* may include a rotary actuator 72. In this embodiment, a shaft of linear actuator 62 may be operably fixedly connected to a rotary actuator 72. The rotary actuator 72 may have an output shaft (not shown) operably coupled to an elongate member 81. The ends of the support material 22*a* may be fixedly secured to the elongate members. The pivot mechanism and lift mechanism may be operably connected to the controller 78. The linear actuator 62 may be used to lift the support material 22 and patient lying thereon. The rotary actuators 72 may then be activated to pivot the elongate members and support material so that the patient is shifted on the support material 22.

Figure 11:
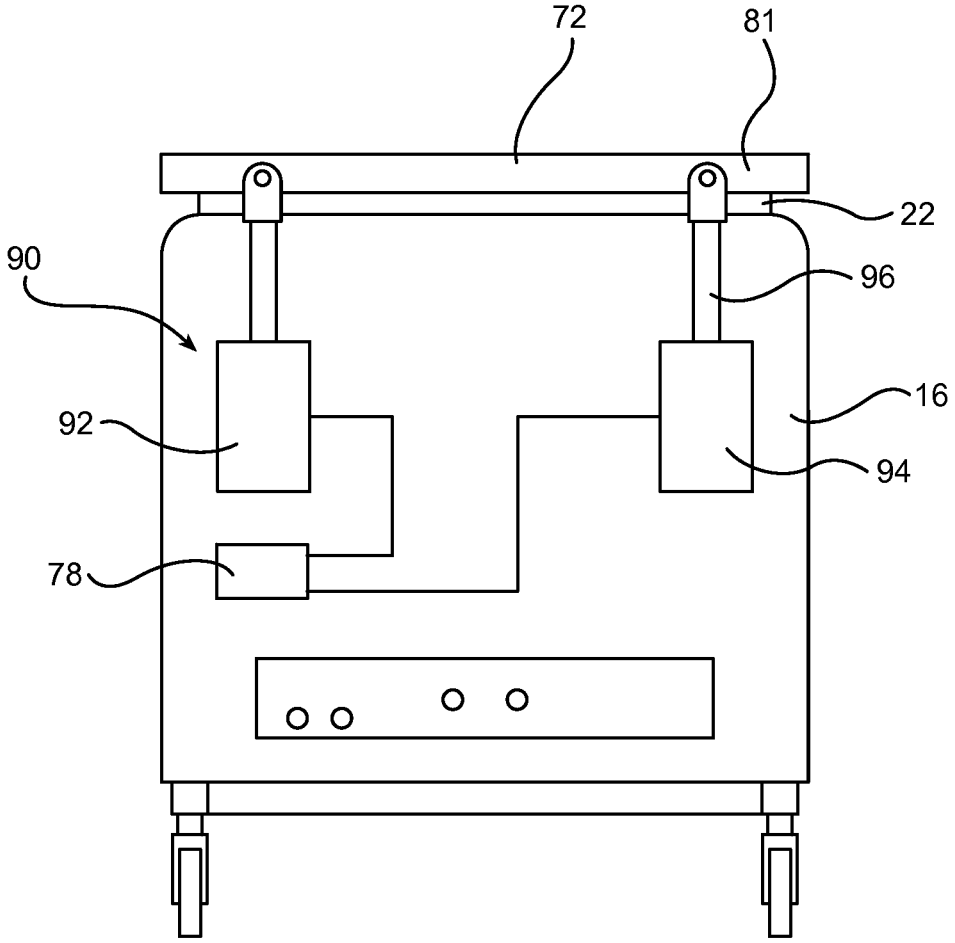
FIGS. 11-13 are schematic end views of still a further alternative embodiment of a patient support apparatus of the present invention showing the support apparatus in various positions.
Figure 12:
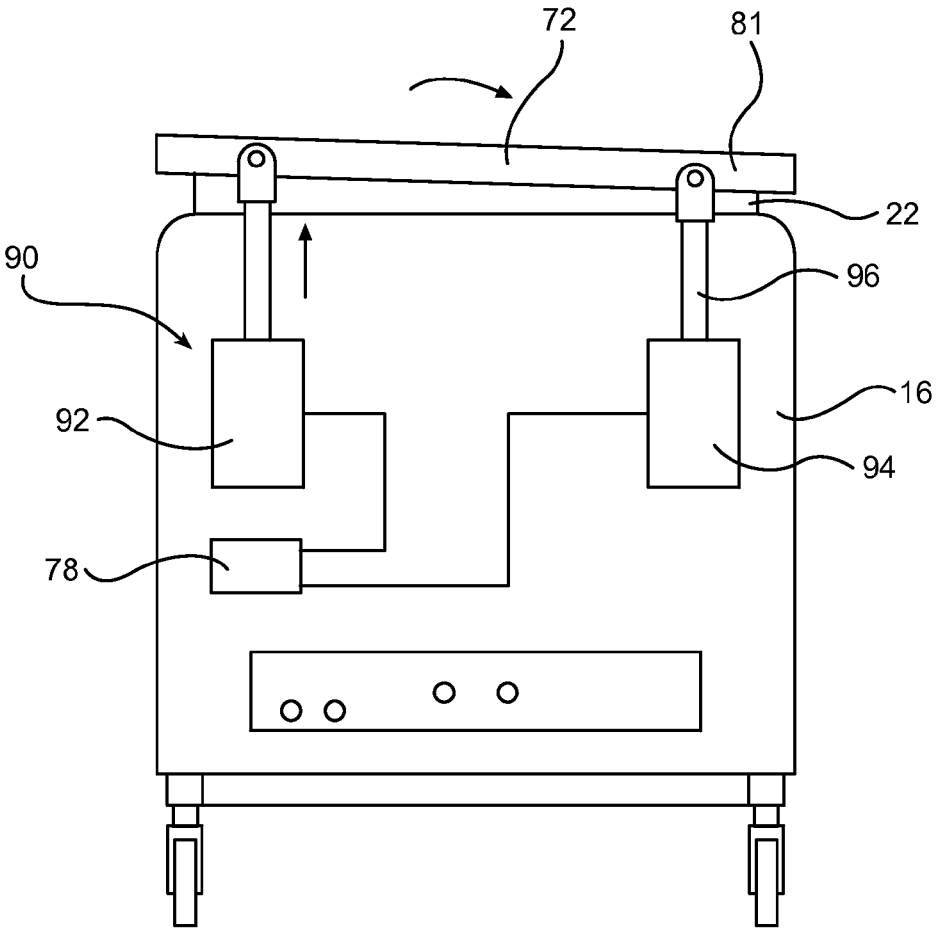
Figure 13:
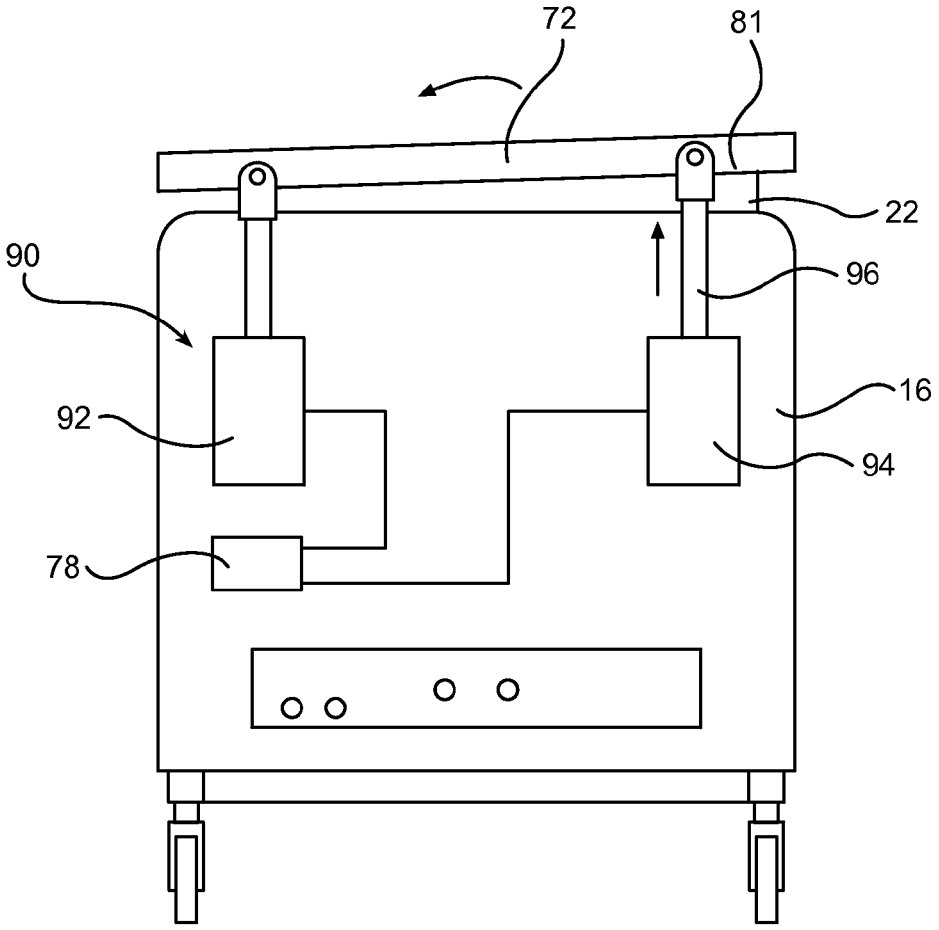

In a further alternative embodiment, the pivot mechanism 90 may be in the form of linear actuators 92 as shown in FIGS. 11-13. The linear actuators by each include a housing 94 and a driven member 96, such as a piston rod. A pair of spaced linear actuators 92 may be secured to each of the end frame supports 16. The housings may be fixedly secured to the end frame supports and the driven members may be pivotally secured to the elongate members 81. The linear actuators 92 may be selectively actuated to tilt the lift mechanism from the level position (FIG. 11) to the tilt right (FIG. 12) and tilt left (FIG. 13) positions. The actuators 92 could be driven hydraulically, automatically or electrically. The actuators 92 may also be controlled to act as the lift mechanism. If both actuators are activated such that they extend, the support material 22 can be raised and lowered. Accordingly, in this embodiment, the function of the lift mechanism and pivot mechanism can be combined.

Alternatively, the pair of linear actuators may be secured to the lift mechanism of the type show in FIGS. 1-2. By selectively actuating the linear actuators the roller assemblies 26 may be pivoted to shift the position of the support material 22 from side to side.

It will be appreciated that variations of the above-disclosed and other features and functions, or alternative thereof, may be desirably combined into many other different systems or applications. Various presently unforeseen or unanticipated alternatives, modifications, variations, or improvements therein may be subsequently made by those skilled in the art which are also intended to be encompassed by the following claims. In addition, the claims can encompass embodiments in hardware, software, or a combination thereof.

What is claimed is:

1. An apparatus for preventing and/or inhibiting decubitus ulcers comprising:

a bed frame including a pair of frame supports spaced from each other, wherein one frame support is a headboard and the other frame support is a footboard;

a contact surface supported on the frame between the headboard and footboard;

a pliable support material extending between the frame supports, the material adapted to support an individual thereon in a generally recumbent position;

a lift mechanism disposed on the frame and operably connected to the support material, the lift mechanism adjusting the position of the support material so that the support material has a first position resting on the contact surface and a second position wherein the support material is raised above the contact surface, wherein the lift mechanism changes a length of the support material in a direction extending between the headboard and footboard to move the support material between the first and second position; and a pivot mechanism operably connected to the lift mechanism and the support material, the pivot mechanism pivoting the support material generally about an axis running along a length of the support material.

2. The apparatus as defined in claim 1, wherein the frame supports extend above the contact surface.

3. The apparatus as defined in claim 2, wherein the lift mechanism is disposed in the frame above the contact surface.

4. The apparatus as defined in claim 1, wherein the lift mechanism includes a first roller operatively connected to a first drive, the first roller being disposed on one of the pair of frame supports, the first roller rolling up a portion of the support material to change its length between the headboard and footboard.

5. The apparatus as defined in claim 4, wherein the lift mechanism includes a second roller operative connected to a second drive, the second roller being disposed on the other of the pair of frame supports.

6. The apparatus as defined in claim 5, wherein the lift mechanism includes a controller, operably connected to the first and second drives.

7. The apparatus as defined in claim 6, wherein the controller operates the first and second roller simultaneously to adjust the tension of the support material to raise and lower the support material relative to the contact surface.

8. The apparatus as defined in claim 7, wherein the controller at predetermined intervals adjusts the tension of the support material between a first tension wherein the support material rests on the contact surface and a second tension wherein the support material is suspended between the frame supports above the contact surface.

9. The apparatus as defined in claim 4, wherein the first roller has an axis of rotation extending in a direction perpendicular to a distance extending between the headboard and footboard.

10. The apparatus as defined in claim 5, wherein the first roller is secured to the headboard and the second roller is secured to footboard, and wherein activation of the first and second rollers causes the length of the support material to be adjusted along a distance between the headboard and footboard.

11. The apparatus as defined in claim 1, wherein the support material includes a stretchable fabric material.

12. The apparatus as defined in claim 1, wherein the lift mechanism selectively raises the support material a distance from the contact surface for a first predetermined period of time and then lowers the support material down onto the contact surface for a second predetermined period of time.

13. The apparatus as defined in claim 1, wherein the lift mechanism includes a first roller fixedly secured to the headboard and a second roller fixedly secured to the footboard, the first and second rollers being attached to the support material.

14. The apparatus as defined in claim 13, wherein at least one of first and second rollers are operated to take in support material thereby shortening the length of the support material extending between the headboard and footboard and raises the support material above the contact surface and to feed out support material to lengthen the length of the support material extending between the headboard and footboard thereby lowering the support material.

15. The apparatus as defined in claim 1, wherein the lift mechanism selectively adjusts a tension of the support material to move the support material to the first position so that the support material has a first tension wherein a weight of an individual disposed on the support material is borne substantially by the contact surface and the lift mechanism selectively adjusts the tension of the support material to move the support material to the second position so that the support material has a second tension wherein the weight of the individual is borne substantially by the contact surface.

16. The apparatus as defined in claim 1, wherein the lift mechanism includes a roller fixedly secured to one of the headboard and footboard, the roller has an axis of rotation extending in a direction perpendicular to a distance extending between the headboard and footboard.

17. A method of preventing and/or inhibiting decubitus ulcers comprising:

supporting an individual on a bed having a mattress disposed in a frame including a pair of frame supports spaced from each other, wherein one frame support is a headboard and the other frame support is a footboard, the bed including a pliable support material extending between and operably connected to the headboard and footboard, the support material adapted to support an individual thereon in a generally recumbent position;

adjusting a length of the material disposed over the mattress in a direction extending between the headboard and footboard to move the support material relative to the mattress and redistribute the weight of the individual relative to the mattress for a predetermined period of time; and following the predetermined time moving the support material disposed over the mattress to lower the individual onto the mattress, wherein the individual is substantially supported by the mattress, and wherein moving the material disposed over the mattress includes pivoting the material relative to the mattress.

18. The method as defined in claim 17, wherein moving the material disposed over the mattress includes listing the material relative to the mattress to substantially support the individual above the mattress for a predetermined period of time.

19. The method as defined in claim 17, further including selecting a time period during which the individual is lifted above the mattress and supported by the material.

20. The method as defined in claim 17, further including selecting a time period during which the individual is supported by the mattress.

21. The method as defined in claim 17, wherein the frame includes a roller fixedly secured to the frame and wherein the roller is operated to take in support material thereby shortening the length of the support material extending between the pair of frame supports to raise the support material above the mattress and to feed out material to lengthen the length of the support material extending between the pair of frame supports to lowering the support material.

* * * * *